US005495802A

United States Patent [19]

Haroutel et al.

[11] Patent Number: 5,495,802

[45] Date of Patent: Mar. 5, 1996

[54] PRINT BLOCK CASSETTE FOR FRANKING MACHINE PRINT DRUM

[75] Inventors: Jean-Claude Haroutel, Orsay; Gérard Moizeau, Longjumeau, both of France

[73] Assignee: Neopost Industrie, Bagneux, France

[21] Appl. No.: 299,545

[22] Filed: Sep. 1, 1994

[30] Foreign Application Priority Data

Sep. 2, 1993 [FR] France ..... 93 10473

[51] Int. Cl.[6] ..... B41F 13/10

[52] U.S. Cl. ..... 101/377; 101/110; 400/175

[58] Field of Search ..... 101/4, 14, 15, 101/16, 23, 28, 91, 110, 377, 375, 29; 400/175, 174

[56] References Cited

U.S. PATENT DOCUMENTS 1,633,245 6/1927 Eskholme .
3,064,566 8/1959 McVicker ..... 101/377
4,252,061 2/1981 Wade, Jr. .

FOREIGN PATENT DOCUMENTS

0217576A2 4/1987 European Pat. Off. .
1031342 6/1953 France .

OTHER PUBLICATIONS

French Search Report FR 9310473.

*Primary Examiner*—Ren Yan
*Attorney, Agent, or Firm*—Sughrue, Mion, Zinn, Macpeak & Seas

[57] ABSTRACT

A print block cassette for franking machine print drums comprises a support having a block support side, longitudinal guide and support members perpendicular to the block support side and engaged in bosses on the support and a plurality of separate print blocks each mounted interchangeably on at least one longitudinal guide and support member.

3 Claims, 5 Drawing Sheets

PRINT BLOCK CASSETTE FOR FRANKING MACHINE PRINT DRUM

BACKGROUND OF THE INVENTION

1. Field of the Invention

The invention concerns an electronic franking machine head.

2. Description of the Prior Art

Electronic franking machines are well known and widely used by most companies and post offices in industrialized countries.

An electronic franking machine head includes a print drum operating in a well known manner to print during a single revolution a postal imprint onto an envelope or other mail item to be franked.

Patent EP-A-0 217 576 describes a franking machine head including a print drum with a housing adapted to receive a set of print wheels for printing four or five digits from 0 through 9 of a stamp, each wheel being rotatable to select the digit to be printed so that any required stamp value can be printed.

The print drum of this head includes other housings for receiving block carrying additional information such as "First Class", "Slogan" and "Penta" messages to be printed alongside the stamp on the envelope or other mail item.

Various countries have various rules and practises with respect to the printing of such additional information.

In France, the postal impression (shown in FIG. 1) includes a stamp 100 having a height of 24 mm by a length of 20 mm, a postmark 101 having a diameter of 24 mm and a "Slogan" 102 having a height of 25 mm by a length of 50 mm or 70 mm.

In the United States there are two postal impressions. The first, shown in FIG. 2, includes a stamp 200 having a length of 35.5 mm by a height of 22 mm, a postmark 201 having a diameter of 22.4 mm, a "First Class" mark 202 having a length of 5.23 mm by a height of 19.05 mm and a "Slogan" 203 having a height of 25 mm by a length of 46.7 mm. The second, shown in FIG. 3, includes a stamp 300 having a length of 35.5 mm by a height of 22 mm, a postmark 301 having a length of 19.81 mm by a height of 14.48 mm, a "Slogan" 302 having a height of 25 mm by a length of 49.5 mm and a five-digit number 303 in which each digit is 3 mm high.

In Canada the postal imprint, shown in FIG. 4, includes a stamp 400 having a length of 35.5 mm by a height of 22 mm, a postmark 401 having a diameter of 22.4 mm, a "First Class" mark 402 having a length of 5 mm by a height of 19.05 mm and a "Slogan" 403 having a height of 25 mm by a length of 46.7 mm.

In Great Britain the imprint, shown in FIG. 5, includes a stamp 500 having a length of 26 mm by a height of 22 mm, a postmark 501 having a diameter of 23 mm and a "Slogan" 502 having a height of 22.25 mm by a length of 46.7 mm.

In Germany the postal imprint, shown in FIG. 6, includes a stamp 600 having a length of 26 mm by a height of 30 mm, a "Gebuhr Bezahlt" mark 601 having a length of 3 mm by a height of 28 mm, a postmark 602 having a diameter of 26 mm, a "Slogan" 603 having a height of 26 mm by a length of 46.7 mm and a mail service label 604.

In the print drum of the previously cited prior art document there is provision for inserting separate block into respective housings on the periphery of the drum according to the various practises used in various countries to print appropriate further information. These various housings complicate the construction of the print drum and the operation of configuring the print head, since as many separate housings are required as there are additional items to print in the postal imprint concerned.

An object of the invention is to propose a device which can be quickly fitted to a franking machine print head in order to adapt it to mailing practises current in different countries.

SUMMARY OF THE INVENTION

The present invention consists in a print block cassette for franking machine print drums comprising a support having a block support side, longitudinal guide and support members perpendicular to said block support side and engaged in sleeves on said support and a plurality of separate print blocks each mounted interchangeably on at least one longitudinal guide and support member.

The cassette can thus incorporate blocks for printing various marks such as "First Class", "Slogan" and "Penta" marks such as are routinely used in postal imprints.

In one simple embodiment of the invention, the cassette includes three longitudinal guide and support members.

In another aspect the invention consists in a print drum for a franking machine comprising a print cylinder having a base, a rotation shaft perpendicular to said base and a part-cylindrical print area facing towards the outside of said cylinder which has a housing delimited in part by two first walls extending radially from said print area and a second wall parallel to said base and spaced therefrom by said first walls, said housing opening towards said print area and towards said base of said cylinder, three spindles extending axially from said second wall towards said base of said cylinder being adapted to be inserted axially into said longitudinal guide and support members of said block cassette as defined hereinabove.

The operator then makes up the postal imprint by means of a set of blocks inserted into the cassette which is then directly inserted into the print drum in one operation.

In a further aspect the invention consists in a print head for franking machines comprising a casing inside which is rotatably mounted a print drum as defined hereinabove, said casing having a side in which is formed an opening facing the base of said print drum and adapted to allow the block cassette as defined hereinabove to be inserted therein in an axial direction by offering up said support side of said cassette perpendicularly to said axial direction.

The cassette can therefore be easily inserted into the print drum from outside the franking machine head and extracted therefrom.

The invention is now described in detail with reference to the drawings.

DETAILED DESCRIPTION OF THE PREFERRED EMBODIMENT

Figure 1:
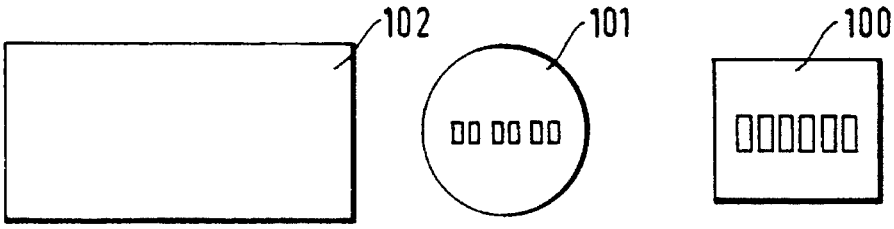
FIG. 1 shows a postal imprint as used in France.
Figure 2:
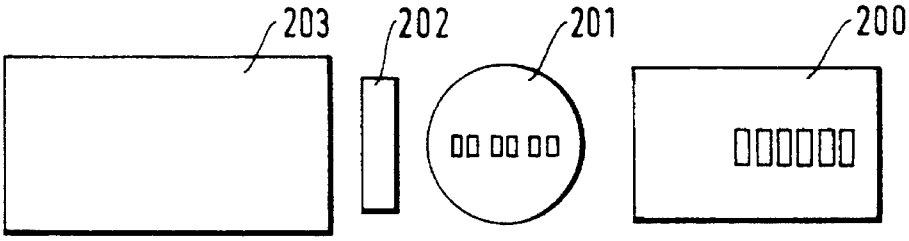
FIG. 2 shows a first postal imprint as used in the United States.
Figure 3:
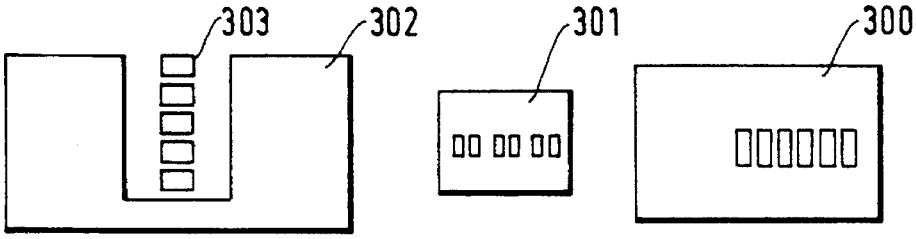
FIG. 3 shows a second postal imprint as used in the United States.
Figure 4:
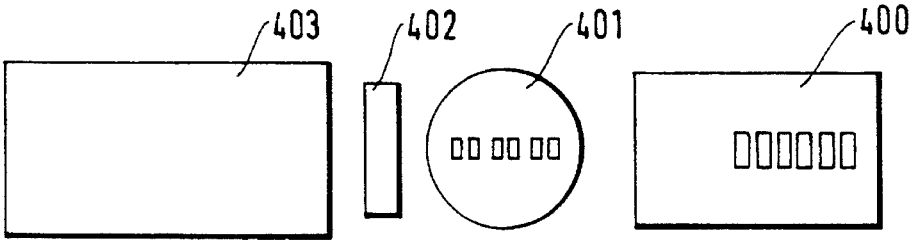
FIG. 4 shows a postal imprint as used in Canada.
Figure 5:
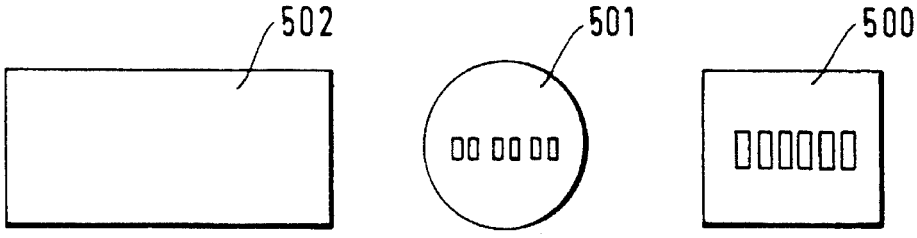
FIG. 5 shows a postal imprint as used in Great Britain.
Figure 6:
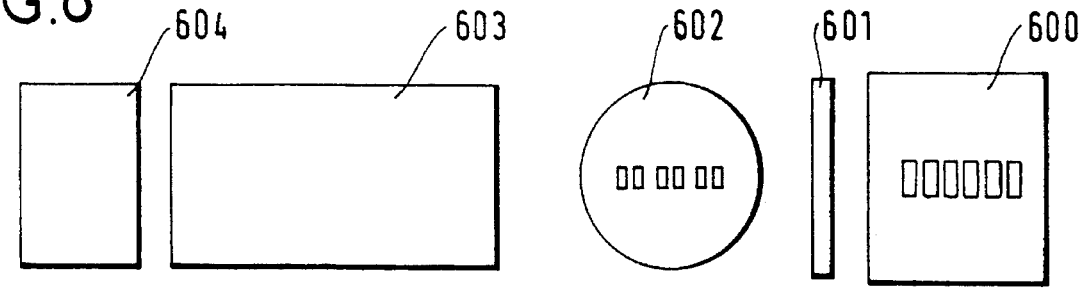
FIG. 6 shows a postal imprint as used in Germany.
Figure 7:
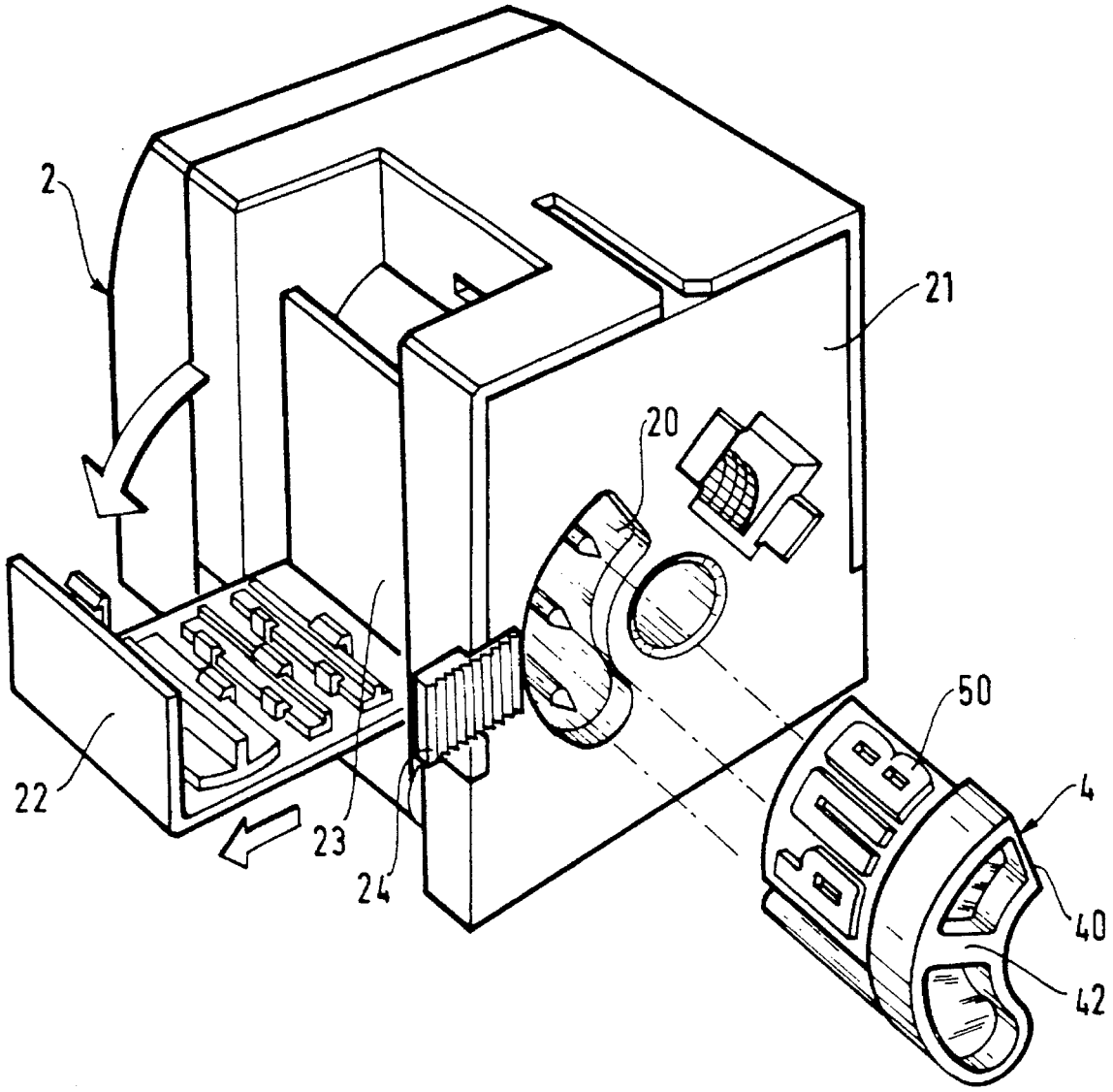
FIG. 7 is a perspective view of a franking machine head in accordance with the invention.
Figure 8:
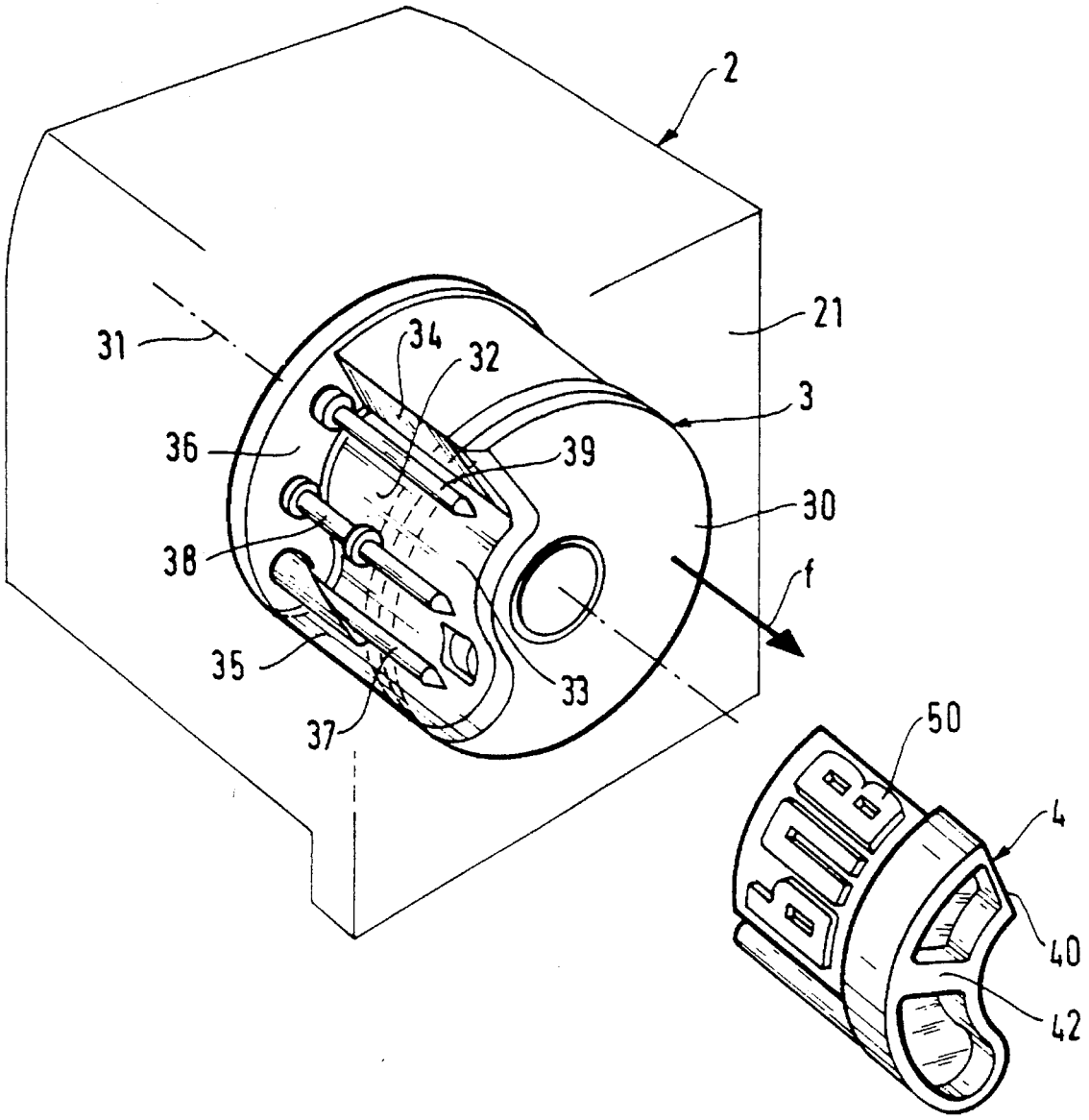
FIG. 8 is a perspective view of a printing block cassette and a print drum in accordance with the invention.

Referring to FIGS. 7 and 8 the head of the franking machine includes a casing 2 inside which is a print drum 3 rotating on a shaft 31 which exits through the rear 21 of the casing.

Referring to FIG. 8, the print drum comprises a print cylinder having a base 30, a rotation shaft 31 perpendicular to the base and a partially cylindrical printing area 32 facing towards the outside of the cylinder.

An opening 20 is formed in the rear 21 of the casing facing the base 30 of the print drum (see FIG. 7).

The opening 20 is designed to enable insertion of the printing block cassette 4 in the axial direction shown by the arrow f.

Referring to FIGS. 7 and 8, the cassette 4 comprises a support 40 on which are mounted various printing blocks each carrying one mark, only one printing block 50 being shown.

As shown in these figures, the cassette 4 is passed through the opening 20 with the printing block 50 at the front. When the cassette 4 is completely inserted into the print head, the printing block 50 is inserted into the print drum and the support 40 nests in the opening 20 which forms a housing.

Referring to FIG. 8, the print drum 3 includes a housing 33 for receiving the printing blocks of the cassette 4. This housing is quarter-cylinder shaped and defined by two radial walls 34, 35 and a part-circular wall 36 at a distance from the base 30 from which it is separated by the walls 34, 35.

Three spindles 37, 38, 39 project from the wall 36 towards the base 30, parallel to the shaft 31. These three spindles are spaced from each other and at the same distance from the shaft 31 on an inside generatrix of the cylinder.

The cassette support 40 has a cross-section complementary to that of the housing 33, which is kidney bean shaped in this example.

Figure 9:
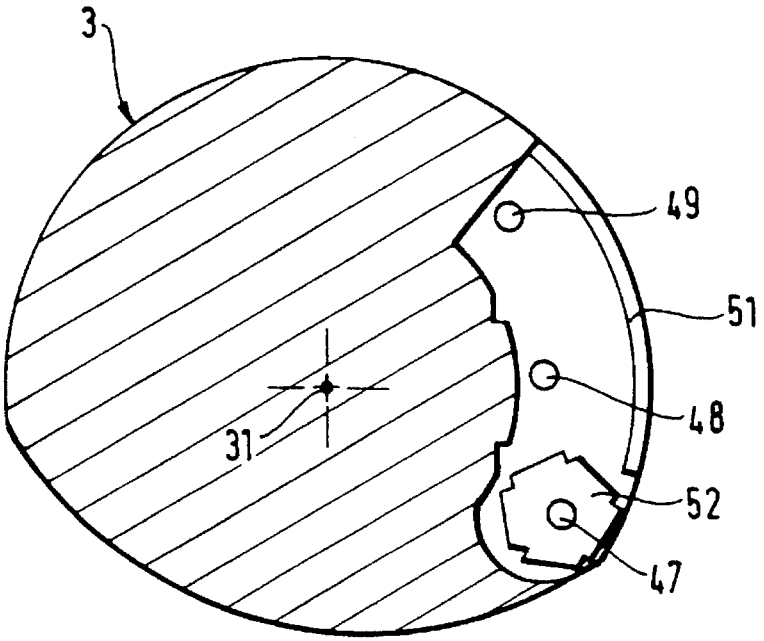
FIG. 9 is a view of the drum shown in FIG. 8 shown in transverse cross-section.

Referring to FIG. 9, two printing blocks 51 and 52 are shown in cross-section in the drum 3. The two blocks are held onto the support 40 by three longitudinal guide and support members 47, 48, 49, the spindles 37 through 39 and the support members 47 through 49 being adapted to insert one within the other.

Figure 10:
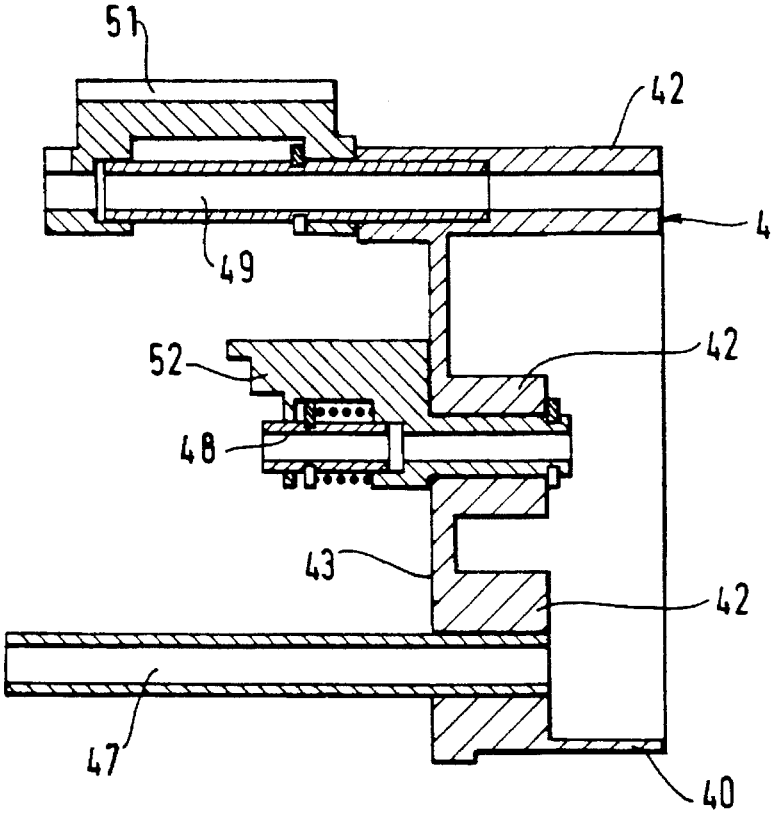
FIGS. 10, 11 and 12 respectively show a printing block cassette in axial longitudinal section equipped for US/Canadian, German and French/English versions.
Figure 11:
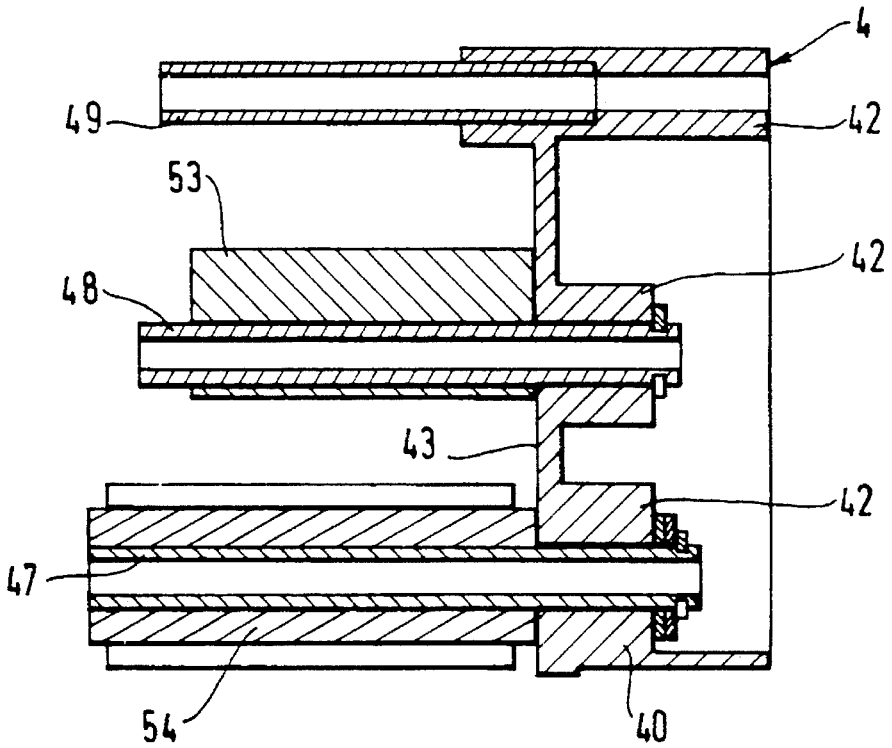
Figure 12:
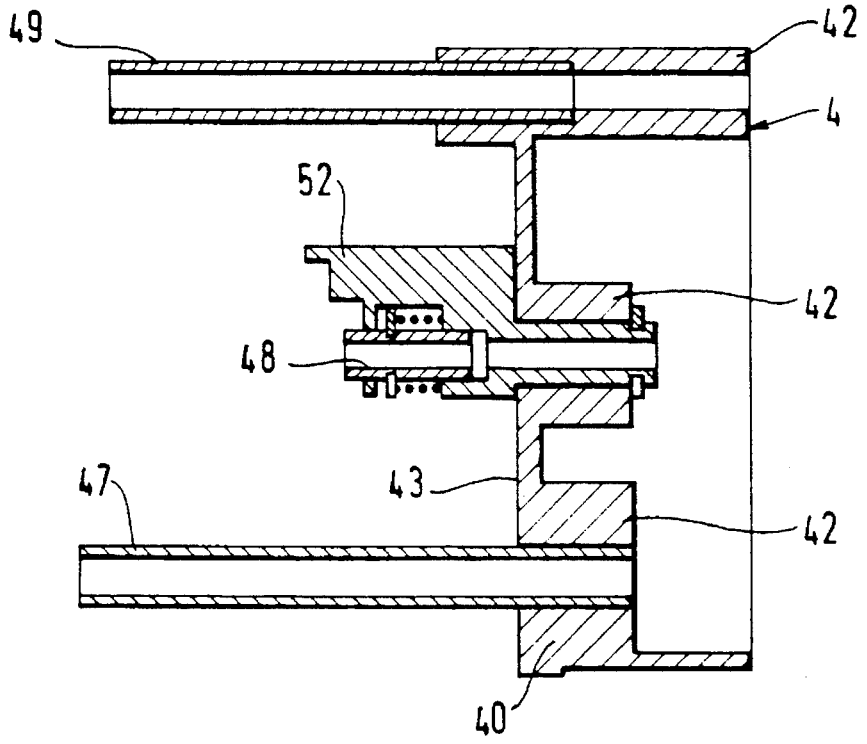

Referring to FIGS. 10 through 12, the support members 47 through 49 extend perpendicularly to the block support surface 43 defining the front of the support. The support members are held in the support 40 by sleeves 42 which project from the rear of the support.

The cavity between the sleeves receives a plug for extracting the cassette from the franking machine head.

The printing blocks are designed to be interchangeable and easily extracted from the support members, using an appropriate tool, for example. A space 23 is provided inside the head casing 2 for stowing the tool and spare blocks on a cover 22 which closes the space 23 (see FIG. 7).

A safety rod 24 slides on the rear surface 21 of the casing to cover the opening 20 when the cassette is inserted into the head to provide a simple way of controlling correct insertion of the support 40 into the opening 20. The insert the cassette 4 into the opening 20 it is necessary to offer up the side 43 of the support 41 perpendicular to the shaft 31.

Referring to FIG. 10, the cassette 4 is shown in the United States/Canada version. It carries on its support member 49 a "First Class" printing block 51, on its support members 48 a cam 52 controlling a "Slogan" printing block, and nothing on its support member 47.

In FIG. 11, the cassette 4 is shown in its German version. It carries nothing on its support member 49, a "Slogan" printing block 53 on its bush 48 and a "Penta" printing block 54 on its support member 47.

In FIG. 12 the cassette 4 is shown in its France/Great Britain version. It carries nothing on its support member 49, a cam 52 controlling the "Slogan" printing block on its support member 48 and nothing on its support member 47.

There is claimed:

1. A print block cassette for franking machine print drums, comprising:

a support having a support side and comprising sleeves;

longitudinal guide and support members extending perpendicularly to said support side; and a plurality of separate print blocks, each having a section which mounts said print block on at least one of said longitudinal support members so that said print block is interchangeable with another print block, said longitudinal guide and support members being held in said sleeves of said support and being adapted to be inserted into said print drum.

2. A print block cassette according to claim 1, wherein said at least one longitudinal guide and support member is a bushing.

3. A print block cassette according to claim 2, including three of said bushings.

* * * * *